US010414035B2

(12) United States Patent
Ohlendorf

(10) Patent No.: US 10,414,035 B2
(45) Date of Patent: Sep. 17, 2019

(54) HANDHELD POWER TOOL

(71) Applicant: Hilti Aktiengesellschaft, Schaan (LI)

(72) Inventor: Oliver Ohlendorf, Landsberg (DE)

(73) Assignee: Hilti Aktiengesellschaft, Schaan (LI)

( * ) Notice: Subject to any disclaimer, the term of this patent is extended or adjusted under 35 U.S.C. 154(b) by 294 days.

(21) Appl. No.: 15/532,787

(22) PCT Filed: Dec. 1, 2015

(86) PCT No.: PCT/EP2015/078122
§ 371 (c)(1),
(2) Date: Jun. 2, 2017

(87) PCT Pub. No.: WO2016/087399
PCT Pub. Date: Jun. 9, 2016

(65) Prior Publication Data

US 2017/0355070 A1 Dec. 14, 2017

(30) Foreign Application Priority Data

Dec. 3, 2014 (EP) ..... 14196018

(51) Int. Cl.
*B25D 16/00* (2006.01)
*B25D 11/06* (2006.01)
(Continued)

(52) U.S. Cl.
CPC ..... *B25D 11/062* (2013.01); *B25D 16/00* (2013.01); *B25D 17/24* (2013.01); *B25D 11/005* (2013.01);
(Continued)

(58) Field of Classification Search
CPC ..... B25D 11/00; B25D 11/10; B25D 11/005; B25D 11/062; B25D 15/02; B25D 16/00;
(Continued)

(56) References Cited

U.S. PATENT DOCUMENTS 3,841,418 A * 10/1974 Biersack ..... B25D 11/005 173/109
4,325,436 A 4/1982 Richter
(Continued)

FOREIGN PATENT DOCUMENTS

CN 1623738 A 6/2005
CN 1704193 A 12/2005
(Continued)

*Primary Examiner* — Scott A Smith
(74) *Attorney, Agent, or Firm* — Davidson, Davidson & Kappel, LLC

(57) ABSTRACT

A hand-held power tool includes a tool holder for holding a tool on a working axis, a pneumatic striking mechanism for striking the tool, and an absorber, which includes a bending spring, situated transversely to the working axis, and a mass body. A countershaft is driven by the motor around a rotation axis which runs in parallel to the working axis. A wobble drive for driving the pneumatic striking mechanism is situated on the countershaft. In addition, a cam disk is situated on the countershaft and includes a cam which projects in a start-up direction which runs in parallel to the working axis. The bending spring includes a counterpiece provided relative to the cam. The cam, which abuts the counterpiece, pretensions the bending spring in the start-up direction.

11 Claims, 4 Drawing Sheets

(51) Int. Cl.

| | |
|---|---|
| ***B25D 17/24*** | (2006.01) |
| *B25F 5/00* | (2006.01) |
| *B25D 17/06* | (2006.01) |
| *B25D 11/00* | (2006.01) |

(52) U.S. Cl.
CPC ..... *B25D 16/006* (2013.01); *B25D 17/06* (2013.01); *B25D 2217/0088* (2013.01); *B25D 2217/0092* (2013.01); *B25D 2250/045* (2013.01); *B25D 2250/245* (2013.01); *B25D 2250/381* (2013.01); *B25F 5/00* (2013.01)

(58) Field of Classification Search
CPC .... B25D 16/003; B25D 16/006; B25D 17/00; B25D 17/06; B25D 17/24; B25D 2216/0023; B25D 2216/0038; B25D 2216/0069; B25F 5/00; B25F 5/001
USPC ... 173/48, 104, 109, 216, 162.1, 162.2, 128, 173/201, 205, 122, 124
See application file for complete search history.

(56) References Cited

U.S. PATENT DOCUMENTS

| | | | | | |
|---|---|---|---|---|---|
| 4,657,088 | A * | 4/1987 | Grossmann | B25D 11/08 | 173/109 |
| 4,719,976 | A * | 1/1988 | Bleicher | B25D 16/003 | 173/109 |
| 5,052,497 | A * | 10/1991 | Houben | B23Q 11/0046 | 173/109 |
| 5,337,835 | A * | 8/1994 | Bohne | B25D 11/005 | 173/109 |
| 6,460,627 | B1 * | 10/2002 | Below | B25D 16/006 | 173/109 |
| 6,988,562 | B2 * | 1/2006 | Hecht | B25D 11/005 | 173/48 |
| 7,287,600 | B2 | 10/2007 | Braun | | |
| 7,987,921 | B2 | 8/2011 | Hahn | | |
| 8,011,445 | B2 * | 9/2011 | Duesselberg | B25D 16/003 | 173/104 |
| 8,307,912 | B2 | 11/2012 | Fisher | | |
| 8,403,075 | B2 * | 3/2013 | Schlesak | B25D 11/062 | 173/109 |
| 8,464,805 | B2 | 6/2013 | Baumann et al. | | |
| 9,415,498 | B2 * | 8/2016 | Hecht | B25D 11/062 | |
| 2011/0017483 | A1 * | 1/2011 | Baumann | B25D 11/062 | 173/162.2 |
| 2012/0125649 | A1 | 5/2012 | Ohlendorf et al. | | |
| 2013/0213682 | A1 | 8/2013 | Schlesak et al. | | |

FOREIGN PATENT DOCUMENTS

| | | | |
|---|---|---|---|
| CN | 101537609 | A | 9/2009 |
| CN | 101795933 | A | 8/2010 |
| GB | 2048753 | | 12/1980 |
| GB | 2408714 | | 6/2005 |
| WO | WO2010069647 | | 6/2010 |
| WO | WO2013140793 | | 9/2013 |

* cited by examiner

HANDHELD POWER TOOL

FIELD OF THE INVENTION

The present invention relates to a chiseling handheld power tool, which includes an absorber for reducing vibrations.

SUMMARY OF THE INVENTION

The handheld power tool includes a tool holder for holding a tool on a working axis, a pneumatic striking mechanism for striking the tool and an absorber, which includes a bending spring situated transversely to the working axis and a mass body. A countershaft is driven by the motor around a rotation axis, which runs in parallel to the working axis. A wobble drive is situated on the countershaft for driving the pneumatic striking mechanism. A cam disk, which includes a cam projecting in a start-up direction, which runs in parallel to the working axis, is also situated on the countershaft. The bending spring has a counterpiece provided with respect to the cam. The cam, which abuts the counterpiece, pretensions the bending spring in the start-up direction.

The absorber is struck by the rotating cam. The striking action takes place in the idle position of the bending spring, which is assumed when the absorber is stopped, or if the absorber has not yet fully reached the steady state. The cam periodically forces a minimum deflection of the absorber. However, the absorber may also be deflected to a greater degree, excited by the vibrations and the handheld power tool. The striking action takes place synchronized with the movement of the striking mechanism and thus the vibrations of the handheld power tool.

One embodiment provides that the cam disk is contact-free with respect to the bending spring when the cam and the counterpiece are in a diametrical angular position with respect to the rotation axis. The cam disk becomes detached from the bending spring each time the cam rotates once around the rotation axis, so that the absorber is able to oscillate freely at least during this phase. The absorber preferably oscillates freely for at least 50% of an oscillation, i.e. without contact with the cam and driven only by the inertia of the mass.

One embodiment provides that the mass body is guided by the bending spring on a curved path. The bending spring may be fastened to the power tool housing by a first end and be fastened to the mass body on a second end, the first end and the second end being situated diametrically to the countershaft. The projection may be from the first end at a distance corresponding to between 30% and 50% of the distance between the first end and the second end.

One embodiment provides that a maximum deflection of the bending spring from an idle position due to the cam abutting the counterpiece is between 1 degree and 5 degrees.

One embodiment provides that the cam has a helical edge facing the bending spring, which ascends in the start-up direction over a central angle between 30 degrees and 90 degrees. The counterpiece may have a helical edge facing the cam, which ascends counter to the start-up direction over a central angle between 30 degrees and 90 degrees. The force introduced onto the absorber during the striking action is preferably kept low. Excitations of higher harmonic oscillations in the bending spring are avoided hereby.

The pneumatic chamber of the striking mechanism achieves maximum compression in an angular position of the countershaft. At this point in time, the cam assumes a special position relative to the projection, which depends on the arrangement of the cam upstream or downstream from the bending spring. If the cam is upstream from the bending spring, the cam and the projection are in the same angular position with respect to the rotation axis, i.e. the cam may deflect the projection to the maximum extent. If the cam is situated downstream from the bending spring, the cam and projection are offset diametrically to the rotation axis, i.e. by 180 degrees. The absorber is optimally excited, tuned to the movement of the striking mechanism.

The wobble drive is at a dead center facing away from the tool in a first angular position of the countershaft. The cam is in an angular position which deflects the bending spring to the maximum extent in a second angular position. If the cam is situated on the side of the bending spring facing away from the tool, the second angular position may advantageously follow the first angular position between 95 degrees and 115 degrees. If the cam is situated on the side of the bending spring facing the tool, the first angular position may advantageously follow the second angular position between 65 degrees and 85 degrees.

BRIEF DESCRIPTION OF THE DRAWINGS

The following description explains the present invention based on exemplary specific embodiments and the figures.

Unless otherwise indicated, identical or functionally equivalent elements are identified by identical reference numerals in the figures.

DETAILED DESCRIPTION

Figure 1:
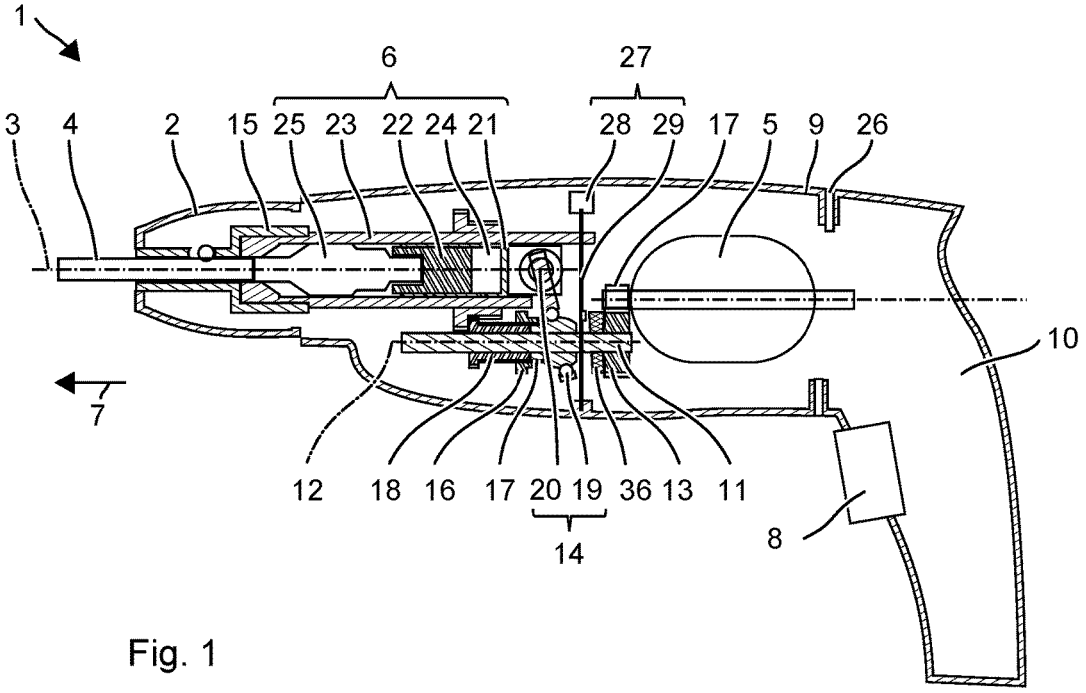
FIG. 1 shows a hammer drill.

FIG. 1 shows an example of a hammer drill 1. Hammer drill 1 includes a tool holder 2, which is able to accommodate a drill 4, a chisel or another tool along a working axis 3. A motor 5 may rotatably drive tool holder 2 around working axis 3. A striking mechanism 6 may also periodically strike the tool held in tool holder 2 in striking direction 7 along working axis 3 for a chiseling operation. Striking mechanism 6 is driven by motor 5. The user places motor 5 into operation with the aid of a main switch 8. Motor 5 and striking mechanism 6 are situated in a power tool housing 9. A battery pack or a power cord supply motor 5 with electric current. The user may guide hammer drill 1 with the aid of a handle 10, which is fastened to power tool housing 9.

Hammer drill 1 includes a switchable gear drive having a countershaft 11. Countershaft 11 is rotatably supported around a rotation axis 12. Rotation axis 12 is in parallel to working axis 3. Motor 5 meshes with a driving pinion 13 on countershaft 11 and continuously drives countershaft 11. Countershaft 11 transmits the torque to a wobble drive 14 for striking mechanism 6 and a rotary drive 15 for tool holder 2. The exemplary gear drive makes it possible to turn the rotary drive of tool holder 2 on and off. A shift sleeve 16 is axially movable on countershaft 11 between a first position and a second position. In the first illustrated position, an inner toothing of shift sleeve 16 engages with a toothing 17 of countershaft 11; in a second position, shift sleeve 16 is disengaged. Shift sleeve 16 is in continuous engagement with a sprocket 18, which is coupled with rotary drive 15 and tool holder 2. A shift knob enables the user to move shift sleeve 16 between the two positions. A similar shift sleeve may be situated on countershaft 11 for turning the wobble drive on and off.

Wobble drive 14 converts the rotational movement of countershaft 11 into a periodic, linear movement for striking mechanism 6. Wobble drive 14 includes a wobble plate 19 and a wobble finger 20. Exemplary wobble plate 19 includes a rolling bearing having an inner ring driven by countershaft 11 and an outer ring connected to wobble finger 20. The outer ring is rotatable in relation to the inner ring around an inclined axis with respect to rotation axis 12 but is prevented from rotating around rotation axis 12 by wobble finger 20 abutting striking mechanism 6. The driven inner ring forces the outer ring and wobble finger 20 to a periodic swiveling movement in a plane E spanned by rotation axis 12 of countershaft 11 and working axis 3 around a swivel axis, which runs through rotation axis 12 and is perpendicular to spanned plane E.

Figure 8:
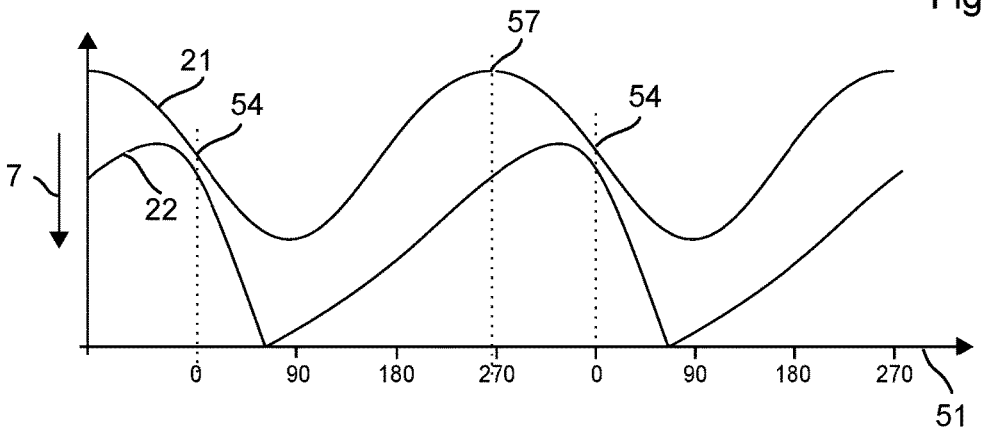
FIG. 8 shows the synchronous movement of the striking mechanism in relation to FIG. 7.

Pneumatic striking mechanism 6 includes an exciter piston 21 and a striker 22, both of which are guided in a guiding tube 23 of striking mechanism 6 coaxially to working axis 3. Exciter piston 21 is connected to wobble finger 20. The swiveling movement of wobble finger 20 is translated into a periodic, linear movement of exciter piston 21. An air spring, formed by a pneumatic chamber 24 between exciter piston 21 and striker 22, couples a movement of striker 22 to the movement of exciter piston 21 (FIG. 8). Striker 22 may strike a rear end of drill 4 directly or transmit part of its impulse to drill 4 indirectly via an essentially idling intermediate striker 25. The number of strikes of striking mechanism 6 is equal to the rotational speed of countershaft 11.

The periodically acting striking mechanism 6 generates shocks in power tool housing 9, which the user perceives as vibrations of handle 10. The vibrations result in an early fatigue of the user and may cause health problems in the case of excessive exposure. Handle 10 may be connected to power tool housing 9 via damping elements 26 to mitigate the vibrations. Damping elements 26 reduce, in particular, high frequency portions of the vibrations and convert them into heat. Damping elements 26 are preferably made from open-pore polymer foams. The effectiveness of damping elements 26 is limited. The guidance of handheld power tool 1 requires a stable and rigid connection of handle 10 to power tool housing 9, while a loose and soft connection would be advantageous for an ideal damping.

Exemplary hammer drill 1 includes an absorber 27 to reduce the vibrations. Absorber 27 includes a mass body 28 and a bending spring 29. Mass body 28 is held only by bending spring 29 and is otherwise preferably unguided. Mass body 28 may move back and forth along working axis 3 on a curved path, an approximately circular path. The curved path is preferably in a plane E spanned by working axis 3 and rotation axis 12 of countershaft 11 (image plane of FIG. 2). Absorber 27 has an idle position 30 (illustrated in FIG. 2), into which mass body 28 and bending spring 29 return when no force is acting upon absorber 27. Mass body 28 may be deflected from idle position 30 on the curved path (cf. FIG. 3 and FIG. 4). Bending spring 29 is elastically bent and applies a backward driving force on mass body 28 into idle position 30. After a deflection 31 out of idle position 30, absorber 27 pivots around itself at its natural frequency. The natural frequency of the mass spring system is predefined by the rigidity of bending spring 29 and the mass of mass body 28.

Figure 4:
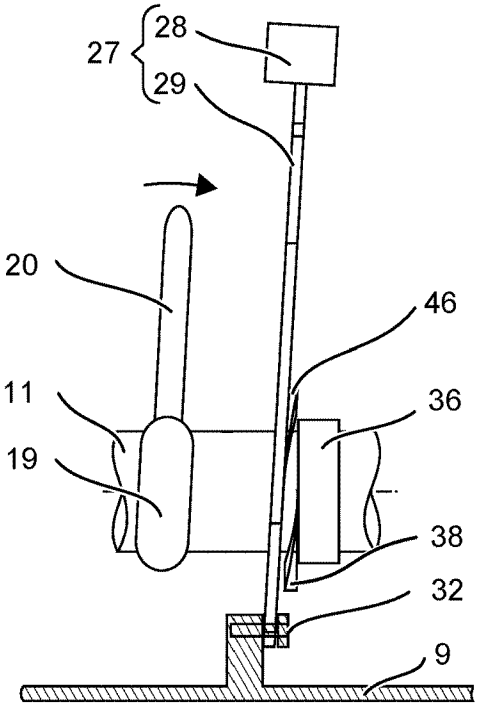
FIG. 4 shows the absorber of the hammer drill, deflected counter to the striking direction.
Figure 3:
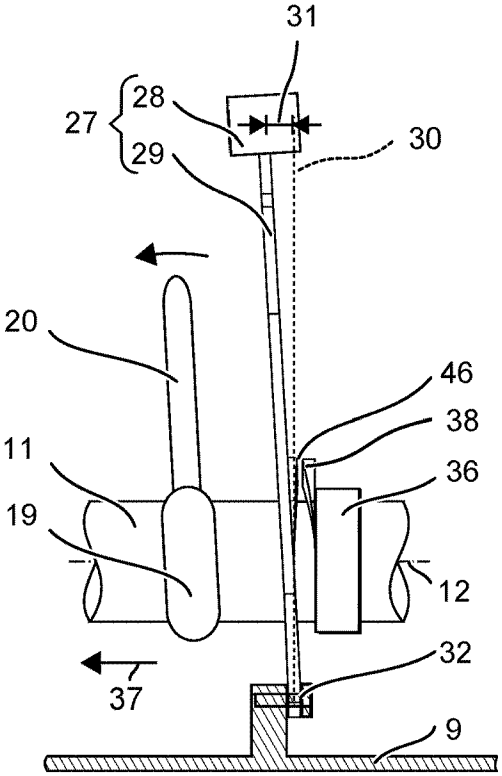
FIG. 3 shows the absorber of the hammer drill, deflected in the striking direction.

Absorber 27 is tuned to striking mechanism 6. The natural frequency is selected to be approximately equal to the number of strikes of striking mechanism 6, for example between 100% and 105% the number of strikes. Inertial mass body 28, which is coupled to power tool housing 9 only via bending spring 29, dynamically counteracts the vibrations of striking mechanism 6, whereby the vibrations of power tool housing 9 acting upon handle 10 are reduced. Due to its inertia, inertial mass body 28 begins to independently move relative to power tool housing 9, once striking mechanism 6 is activated and vibrations occur. Excited by striking mechanism 6, mass body 28 oscillates between two reversal points, which are illustrated in FIGS. 3 and 4. The amplitude of deflection 31 depends on the load of hammer drill 1. The deflection is known from test series for the typical applications, e.g. for working on reinforced concrete. Deflection 31 hereinafter designates the angle of inclination of bending spring 29 with respect to its idle position 30.

Figure 2:
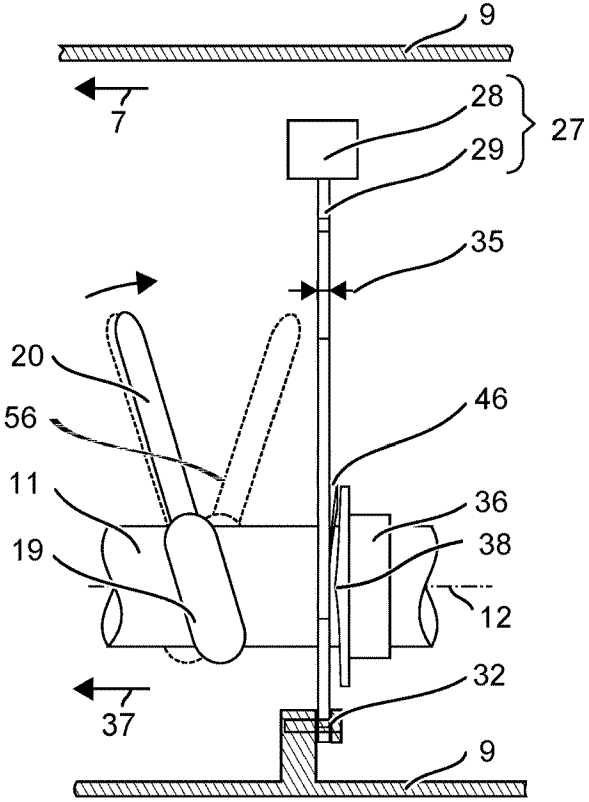
FIG. 2 shows the absorber of the hammer drill in the idle position.

FIG. 2 shows exemplary absorber 27 in its idle position 30. In the idle position, bending spring 29 is situated essentially perpendicularly to working axis 3. One end of bending spring 29 is designed as suspension 32 and is fastened to power tool housing 9. Mass body 28 is fastened on distal end 33 of bending spring 29 with respect to suspension 32. The distance between distal end 33 and suspension 32 is the largest dimension or length 34 of bending spring 29. A thickness 35 of bending spring 29, i.e. its dimension along working axis 3, is at least one magnitude less than length 34. Bending spring 29 is elastically bendable along working axis 3. Mass body 28 moves around suspension 32 on the curved path. Length 34 of bending spring 29 specifies the distance from suspension 32. The curved path effectively approximates a circular path having a radius equal to length 34. Bending spring 29 curves as the deflection increases, whereby the radius is shortened. Bending spring 29 is preferably rigid in the third spatial direction. The curved path preferably runs in plane E spanned by working axis 3 and rotation axis 12 of countershaft 11 (image plane of FIG. 2). Mass body 28 and suspension 32 are situated symmetrically with respect to plane E. Absorber 27 is preferably situated in a sufficiently large cavity in power tool housing 9, so that mass body 28 does not touch any element except for bending spring 29 in power tool housing 9 under typical vibrations.

A cam disk 36 facilitates the steady state of absorber 27, in particular when striking mechanism 6 is initially accelerated to the provided number of strikes. Cam disk 36 deflects absorber 27 onto a side of its idle position 30 in a start-up direction 37; cam disk 36 situated upstream from absorber 27, for example in striking direction 7, deflects absorber 27 onto the side of idle position 30 facing away in striking direction 7. Cam disk 36 does not come into contact with absorber 27 when absorber 27 oscillates to the other side of idle position 30 (FIG. 4). Typical deflection 38 of absorber 27 in the steady state and including an active striking mechanism 6 is advantageously greater than possible deflection 38 of absorber 27 forced by cam disk 36. Absorber 27 oscillates freely according to its natural frequency, i.e. predefined solely by the inertia of mass body 28 and rigidity of bending spring 29.

Cam disk 36 is situated on countershaft 11, adjacent to bending spring 29. Cam disk 36 may be integrated into driving pinion 13, integrated into wobble plate 19 or be designed as an independent disk. Countershaft 11 drives cam disk 36 at the same rotational speed as wobble plate 19, whereby the wobbling movement of wobble plate 19 and the rotational movement of cam disk 36 have a constant angle offset. Cam disk 36 may be coupled to or decoupled from countershaft 11 together with wobble plate 19 to activate or deactivate striking mechanism 6.

Figure 6:
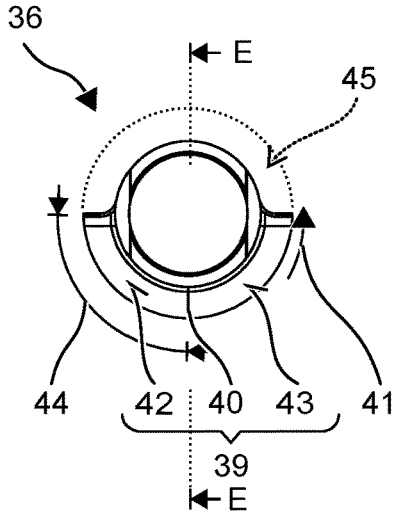
FIG. 6 shows the cam disk for striking the absorber.

Cam disk 36 includes a single cam 39, which projects toward bending spring 29 in a start-up direction 37 which runs in parallel to working axis 3. Exemplary cam 39 includes an apex 40, a rising edge 42 up to apex 40 in circumferential direction 41 and a falling edge 43 downstream from apex 40 (FIG. 6). Helical edges 42, 43 ascend in start-up direction 37 or descend in start-up direction 37. Edges 42 may ascend around rotation axis 12 linearly with the rotation angle. A central angle 44 of rising edge 42 is, for example, in the range between 45 degrees and 90 degrees. Falling edge 43 is preferably designed to be symmetrical to rising edge 42. Entire cam 39 covers a maximum central angle of 180 degrees. Exemplary cam disk 36 has a recess 45 outside cam 39 at the same radial distance from rotation axis 12. Cam disk 36 may come into contact with bending spring 29 only via the one cam 39. Driven by countershaft 11, cam 39 passes over an annular rotation volume coaxial to rotation axis 12.

Bending spring 29 has a projection 46 projecting toward cam disk 36 counter to start-up direction 37, which may be struck by cam 39. Projection 46 projects into rotation volume passed over by cam 39 when bending spring 29 is in the idle position. Projection 46 may have the same design as cam 39. Exemplary projection 46 has an apex 47 which projects in the direction of cam disk 36. Projection 46 has a rising edge 48 in the clockwise direction toward apex 47 and a falling edge 49 following apex 47. A central angle 50 of rising edge 48 is, for example, in the range between 45 degrees and 90 degrees. Apex 47 is preferably situated in plane E between mass body 28 and countershaft 11.

Figure 7:
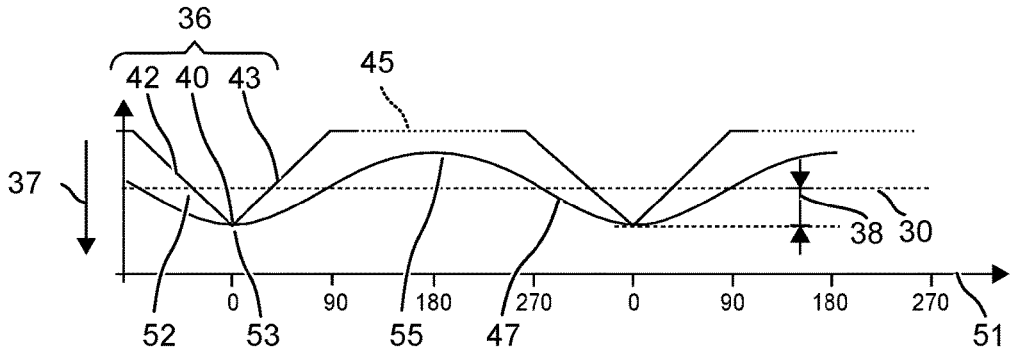
FIG. 7 shows the relative movement of the absorber and of a cam of the cam disk.

FIG. 7 illustrates the striking of absorber 27 by cam disk 36. The ordinate shows the position of cam disk 36 and bending spring 29 along working axis 3 in plane E. The position is plotted over cyclical angular position 51 of countershaft 11. Angular position 51 at 0 degrees is situated in plane E and points toward mass body 28. The movement of absorber 27 is represented by projection 46 or its apex 47. For the following explanations, the movement of absorber 27 is represented by vibrations without excitation, at which a greater deflection typically sets in. The dashed line indicates the position of apex 47 in idle position 30.

Cam disk 36 rotates around rotation axis 12, driven by countershaft 11. Cam 39 approaches projection 46 of bending spring 29. Cam 39 moves past idle position 30 of projection 46 with rising edge 42 in start-up direction 37. For example, cam 39 moves past idle position 30 at an angular position 52 of −45 degrees. Angular position 52 results from the axial distance between cam disk 36 and idle position 30. If absorber 27 is unmoved and thus projection 46 is in idle position 30, cam 39 begins to deflect and clamp absorber 27 in start-up direction 37. Maximum deflection 38 forced by cam 39 is achieved when apex 40 of cam 39 has an angular position 53 aligned with apex 47 of projection 46. Aligned apexes 40, 47 are both at 0 degrees, for example. The two apexes 40, 47 are in plane E with mass body 28 and the oscillation plane of absorber 27. Maximum forced deflection 38 is in the range between 1 degree and 5 degrees.

Following maximum forced deflection 38, cam 39 moves away from projection 46 by falling edge 43. Cam 39 does not apply any more force onto bending spring 29 in start-up direction 37. Accordingly, bending spring 29 relaxes and accelerates mass body 28 counter to start-up direction 37 in the direction of idle position 30. Projection 46 moves at increasing velocity counter to start-up direction 37. The rate of descent of falling edge 48 at the rotational speed of countershaft 11 is selected to be greater than the velocity of projection 46. Accordingly, a gap opens between bending spring 29 and cam disk 36. The movement of absorber 27 is now predefined solely by the inertia of mass body 28 and the rigidity of bending spring 29. The free movement lasts for at least 75% of one revolution of countershaft 11 (270 degrees).

Absorber 27 oscillates over idle position 30 and reaches its maximum deflection 31 counter to start-up direction 37 when cam 39 is at approximately 180 degrees. Cam 39 is again in plane E but on the side of countershaft 11 facing suspension 32 of bending spring 29. Cam 39 and projection 46 are situated diametrically to rotation axis 12. A recess 54 of bending spring 29 is preferably situated opposite cam 39 along rotation axis 12, and recess 45 of cam disk 36 is preferably situated opposite projection 46 along rotation axis 12. Cam disk 36 and bending spring 29 do not touch each other in diametrical angular position 55, regardless of the amplitude of deflection 31 of bending spring 29. Amplitude 38 illustrated in FIG. 7 includes only the excitation by cam disk 36; in chiseling hammer drill 1, deflection 38 is at least 20% greater in the typical applications.

Maximum forced deflection 38 of absorber 27 preferably takes place simultaneously with the maximum compression of pneumatic chamber 24. Countershaft 11 synchronously drives wobble finger 20 and thus indirectly striking mechanism 6 as well as cam disk 36. Wobble finger 20 periodically reaches its dead center 56 facing away from the tool at an angular position 57, for example at 255 degrees (−105 degrees). Wobble finger 20 subsequently moves itself and exciter piston 21 in striking direction 7. Pneumatic chamber 24 of striking mechanism 6 is compressed. The maximum compression is reached between 95 degrees and 115 degrees after dead center 56. The fixed angle offset of wobble drive 14 with respect to cam disk 36 is selected in such a way that aligned angular position 53 of cam 39 in relation to projection 46 follows dead center 56 of wobble drive 14 facing away from the tool between 95 degrees and 115 degrees. The angle offset shifts by 180 degrees if cam disk 36 is situated on the tool side of bending spring 29.

Already oscillating absorber 27 is to be interfered with as little as possible by cam 39. Projection 46 is designed to quickly leave the area over which cam 39 passes. Apex 47 is situated on a side of countershaft 11 facing away from suspension 32. The distance between apex 47 and suspension 32 is between 30% and 50% of length 34 of bending spring 29.

Figure 5:
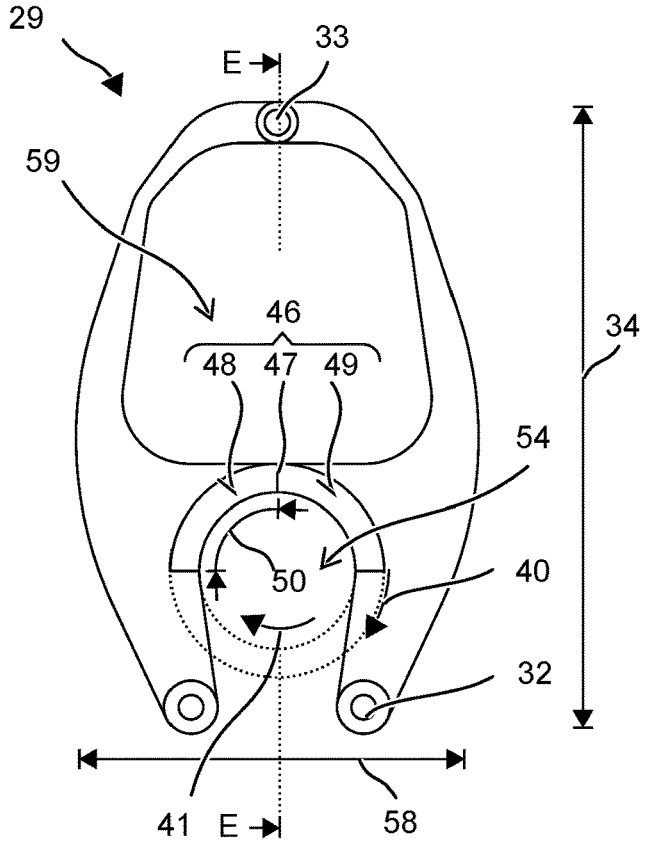
FIG. 5 shows the bending spring of the absorber.

Bending spring 29 may be reinforced perpendicularly to the plane. Width 58 of bending spring 29 is preferably greater than its thickness 35 and less than its length 34. Exemplary bending spring 29 is designed as a sheet-like leaf spring (FIG. 5). Bending spring 29 encompasses countershaft 11. Suspension 32 of bending spring 29 and distal end 33, including mass body 28, are on diametrically opposed sides of countershaft 11. Bending spring 29 has, for example, a recess 59, through which countershaft 11 is guided. Bending spring 29 may have another recess 54, through which striking mechanism 6, situated in parallel to countershaft 11, is guided. Recesses 54, 59 are sufficiently dimensioned in such a way that bending spring 29 does not strike countershaft 11 and striking mechanism 6 when it is deflected by mass body 28. Bending spring 29 is made, for example, from spring steel or a fiber-reinforced composite.

What is claimed is:

1. A handheld power tool comprising:

a tool holder for holding a tool on a working axis;

a motor;

a pneumatic striking mechanism for striking the tool;

an absorber including a bending spring situated transversely to the working axis and a mass body;

a countershaft driven by the motor around a rotation axis running in parallel to the working axis;

a wobble drive situated on the countershaft for driving the pneumatic striking mechanism;

a cam disk situated on the countershaft, the cam disk including a cam projecting in a start-up direction and running in parallel to the working axis; and a counterpiece to the cam provided on the bending spring, the cam pretensioning the bending spring in the start-up direction adjacent to the counterpiece.

2. The handheld power tool as recited in claim 1 wherein the cam disk is contact-free with respect to the bending spring when the cam and the counterpiece are in a diametrical angular position with respect to the rotation axis.

3. The handheld power tool as recited in claim 1 wherein the cam disk is contact-free with respect to the bending spring for at least 75% of one rotation around the rotation axis.

4. The handheld power tool as recited in claim 1 wherein the mass body is guided by the bending spring on a curved path.

5. The handheld power tool as recited in claim 1 further comprising a power tool housing and wherein the bending spring is fastened to the power tool housing by a first end and is fastened to the mass body on a second end, the first end and the second end being situated diametrically to the countershaft.

6. The handheld power tool as recited in claim 5 wherein the counterpiece of the cam is at a distance from the first end corresponding to between 30% and 50% of the distance between the first end and the second end.

7. The handheld power tool as recited in claim 1 wherein a maximum forced deflection of the bending spring from an idle position due to the cam abutting the counterpiece is between 1 degree and 5 degrees.

8. The handheld power tool as recited in claim 1 wherein the cam has a helical edge facing the bending spring, the helical edge ascending in the start-up direction over a central angle between 30 degrees and 90 degrees.

9. The handheld power tool as recited in claim 1 wherein the counterpiece has a helical edge facing the cam, the helical edge ascending counter to the start-up direction over a central angle between 30 degrees and 90 degrees.

10. The handheld power tool as recited in claim 1 wherein a pneumatic chamber of the striking mechanism achieves maximum compression at an angular position of the countershaft, the cam being situated in the angular position of the countershaft and, in an arrangement of the cam on a side of the bending spring facing away from the tool, lies in the angular position as the counterpiece with respect to the rotation axis, or the cam being situated in the angular position and, in an arrangement of the cam on a side of the bending spring facing the tool, lies diametrically to the counterpiece with respect to the rotation axis.

11. The handheld power tool as recited in claim 1 wherein the wobble drive is in a dead center facing away from the tool in a first angular position of the countershaft, and the cam is in an angular position deflecting the bending spring to a maximum extent in a second angular position, and in an arrangement of the cam on the side of the bending spring facing away from the tool, the second angular position follows the first angular position between 95 degrees and 115 degrees, and in an arrangement of the cam on the side of the bending spring facing the tool, the first angular position follows the second angular position between 65 degrees and 85 degrees.

* * * * *